US007219451B2

(12) United States Patent
Chretien

(10) Patent No.: US 7,219,451 B2
(45) Date of Patent: May 22, 2007

(54) CYCLIST'S SHOE WITH A CLEAT FOR RETAINING THE SHOE ON AN AUTOMATIC SECUREMENT PEDAL

(75) Inventor: Jean-Louis Chretien, Cours les Barres (FR)

(73) Assignee: Look Cycle International, Nevers (FR)

( * ) Notice: Subject to any disclaimer, the term of this patent is extended or adjusted under 35 U.S.C. 154(b) by 272 days.

(21) Appl. No.: 10/902,018

(22) Filed: Jul. 30, 2004

(65) Prior Publication Data

US 2005/0022432 A1 Feb. 3, 2005

(30) Foreign Application Priority Data

Jul. 30, 2003 (FR) ..... 03 09364

(51) Int. Cl.
*A43B 5/00* (2006.01)

(52) U.S. Cl. ..... 36/131; 74/594.4

(58) Field of Classification Search ..... 36/131; 74/594.4, 594.6

See application file for complete search history.

(56) References Cited

U.S. PATENT DOCUMENTS 4,506,463 A * 3/1985 Chassaing ..... 36/131
5,079,968 A * 1/1992 Starner ..... 74/594.6
5,685,093 A * 11/1997 Lin ..... 36/131
5,878,514 A * 3/1999 Ueda et al. ..... 36/131
5,924,220 A 7/1999 Ueda et al.
6,189,242 B1 * 2/2001 Lin ..... 36/131
6,244,136 B1 * 6/2001 Chen ..... 74/594.6
2005/0210712 A1 * 9/2005 Jau et al. ..... 36/131

FOREIGN PATENT DOCUMENTS

| | | |
|---|---|---|
| EP | 0 063 542 | 10/1982 |
| EP | 1 236 410 | 9/2002 |
| FR | 2 680 306 | 2/1993 |

* cited by examiner

*Primary Examiner*—Marie Patterson
(74) *Attorney, Agent, or Firm*—Young & Thompson

(57) ABSTRACT

A cyclist's shoe includes a sole provided with a device for securing a retaining cleat of the shoe on an automatic cycle pedal. The device has first securement members disposed within the thickness of the sole facing through holes provided in the sole and permitting the first securement members to coact with second securement members acting on the cleat, and a device for positioning the cleat relative to the sole permitting placing the cleat in a predetermined position of use. The shoe moreover includes a locating device with a device for locating the predetermined position of use of the cleat permitting the emplacement of another similar cleat in the predetermined position of use.

20 Claims, 7 Drawing Sheets

CYCLIST'S SHOE WITH A CLEAT FOR RETAINING THE SHOE ON AN AUTOMATIC SECUREMENT PEDAL

The present invention relates to a cyclist's shoe with a cleat for retaining the shoe on an automatic securement pedal.

The notion of "automatic" is connected to the fact that the shoe carries a coupling member or retaining cleat in the form of a plate fixed below the shoe sole and adapted to effect a hands-free securement by quite simply urging this cleat against the securement means provided on the pedal. These latter are connected to the body of the pedal and comprise a front fixed member for engagement of the cleat and a movable rear retaining member which can be resiliently swung between a position to free the cleat and a position to retain the latter against a retention plane on the pedal body.

Pedals of this type differ from each other essentially by the use of automatic securement means used to connect the cleat to the pedal body. These pedals are nowadays widely known and will not be described in greater detail, the more so as they do not relate directly to the invention, but constitute instead the field of application of the invention.

Thus, the invention relates in particular to the use of a cyclist's shoe used with an automatic pedal and comprising securement means for such a retaining cleat. In a known shoe, these securement means are disposed over the thickness of the sole and comprise three plates of which each is provided with a tapped hole adapted to coact with a securement screw passing through a hole provided in the sole to secure the retention cleat. These three plates are disposed at the apices of an imaginary triangle.

The retention cleat, which has a generally triangular shape, comprises three longitudinal grooves, namely a central forward groove and two lateral rear grooves, receiving the securement screws. A recess is formed about each groove to receive a crosspiece also provided with a longitudinal groove. The head of the corresponding securement screw thus bears against this crosspiece. This arrangement permits the longitudinal positioning of the cleat and the recesses sufficiently wide relative to the crosspiece to permit a center transverse positioning so as to position the cleat relative to the sole in a predetermined position of use.

Thus, the initial positioning of the retention cleat during its securement below the shoe sole is very important for the cyclist because the correct positioning determines on the one part the effectiveness of pedaling with good transmission of force, and permits on the other hand avoiding damage, to the muscles or joints, which can result from poor positioning of the cleat.

Moreover, when the user walks on the ground, and as a function of the nature of the latter, the cleat fixed below the shoe sole is subjected to severe forces and damage such as shocks and scratches which cause it relatively rapidly to deteriorate, the more so as these cleats are generally of plastic material. As a result, the retention cleat constitutes a wear member which must be replaced periodically or after accidental damage.

However, known shoes do not comprise any means permitting exactly fixing the position of the cleat relative to the sole and the user is thus obliged to use outlines or adhesives disposed below the sole before taking off a cleat for its replacement by a new cleat, so as to be able to place the latter in exactly the same position as the preceding one.

The invention has for its object to overcome this drawback by providing a cyclist's shoe provided with means permitting "memorizing" the present position of the cleat and to retain it for the correct positioning of a new cleat.

The object of the invention is a cyclist's shoe comprising a sole provided with securement means for a retention cleat of the shoe on an automatic cycle pedal, said securement means comprising first securement members disposed in the thickness of the sole facing through-holes provided in the sole and permitting said first securement members to coact with second securement members acting on said cleat to grip it against the sole, and positioning means for the cleat relative to the sole permitting placing the cleat in a predetermined use position before the securement of the latter with the aid of said securement means, characterized by the fact that it comprises a locating device comprising means for locating said predetermined position of use of the cleat, permitting the emplacement of another similar cleat in said predetermined position of use.

According to other characteristics of the invention:

said locating means comprise a first locating member longitudinally movable relative to the sole, and connection means passing through a longitudinal slot in the sole so as to connect said first locating member to a second locating member so as to immobilize them relative to each other in said predetermined position of use of the cleat;

said second locating member is transversely movable relative to the sole;

the first locating member is disposed in a recess of the sole and the second locating member is received in a seat provided on the upper surface of the cleat;

said first locating member is slidably mounted in the longitudinal direction of the sole, and said second locating member comprises a transverse groove receiving said connection means so as to permit the movement of said second locating member in the transverse direction of the sole;

said locating means comprise a T shaped element extending in the longitudinal direction of the sole and carrying at each end a securement hole receiving said securement means of the cleat;

said first locating member comprises said T shaped element mounted slidably in the longitudinal direction of the sole and provided with a securement hole adapted to receive said connection means, said first and second locating members, and said holes passing through the sole being constituted by longitudinal slots disposed facing said securement holes in said T shaped element;

said T shaped element comprises on its lower surface about at least two of the securement holes, a respective protuberance projecting into one of the corresponding slots of the sole so as to form guide means for said T shaped element during longitudinal movement of the latter;

said first locating member comprises an element slidably mounted on the stem of the T shaped element and provided with a securement hole adapted to receive said connection means of said first and second locating members, and said T shaped element comprises a longitudinal slot for receiving said connecting means of said first and second locating members;

said first locating member comprises on its lower surface about said securement hole, a protuberance projecting into said longitudinal soft T shaped element so as to form a guide means for said first locating member during longitudinal movement of the latter;

said first locating member comprises a pair of lateral tongues extending on opposite sides of the stem of the T shaped element so as to form lateral guide members;

said second locating member is in the form of a plate adapted to be blocked in said seat on the upper surface of the cleat by shape mating means at least partially between the contour of said plate and the internal contour of said seat;

said plate comprises at its rear end an indentation receiving a projection in said seat on the upper surface of the cleat;

said plate comprises at its forward end a protuberance having a shape adapted to coact with a recess of corresponding shape in said seat.

Other characteristics and advantages of the invention will become apparent from the description which follows, of two non-limiting embodiments of the invention, with reference to the accompanying drawings, in which.

Figure 9:
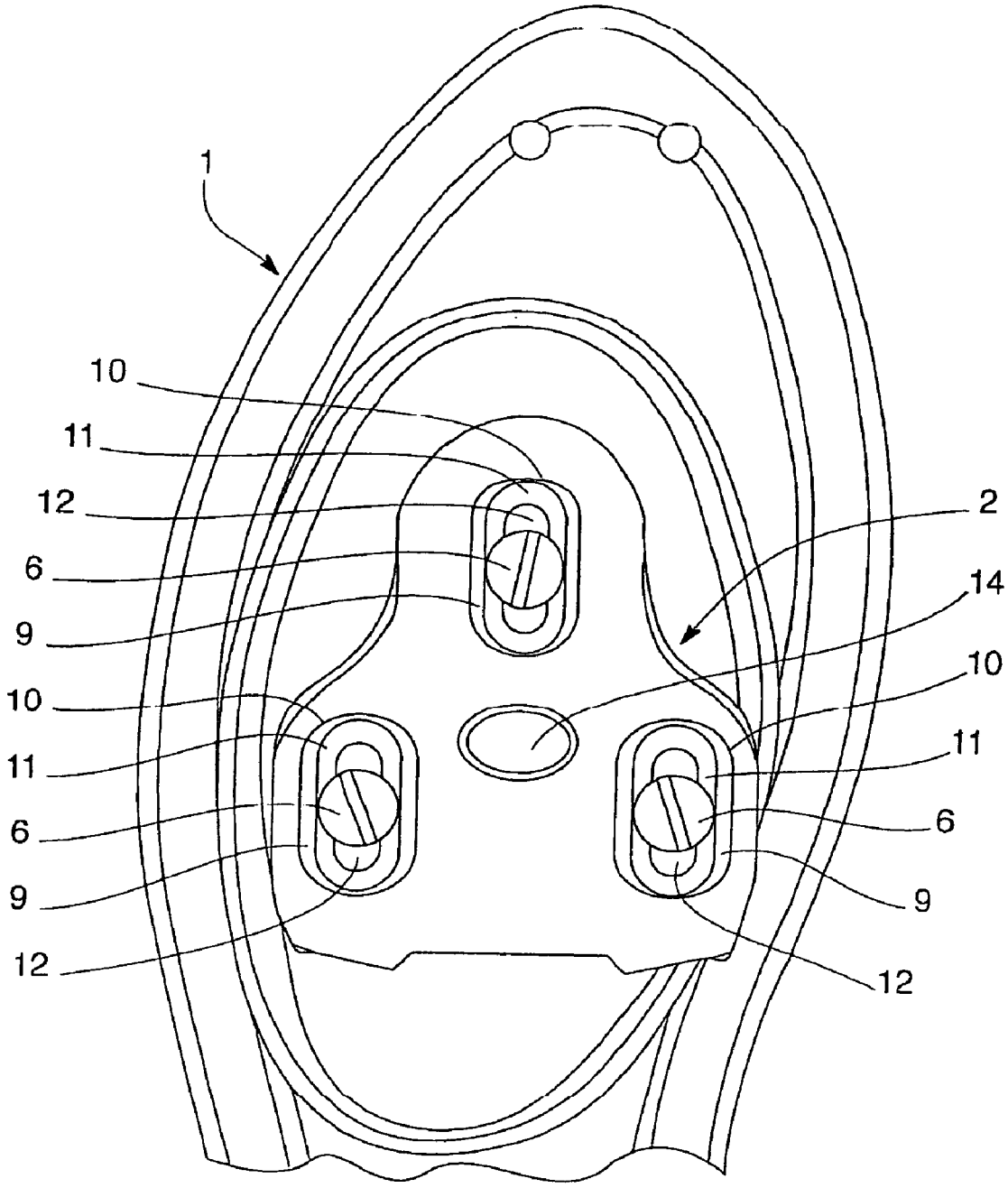
FIG. 9 is a view from below of the shoe sole with the cleat fixed below the sole.
Figure 10:
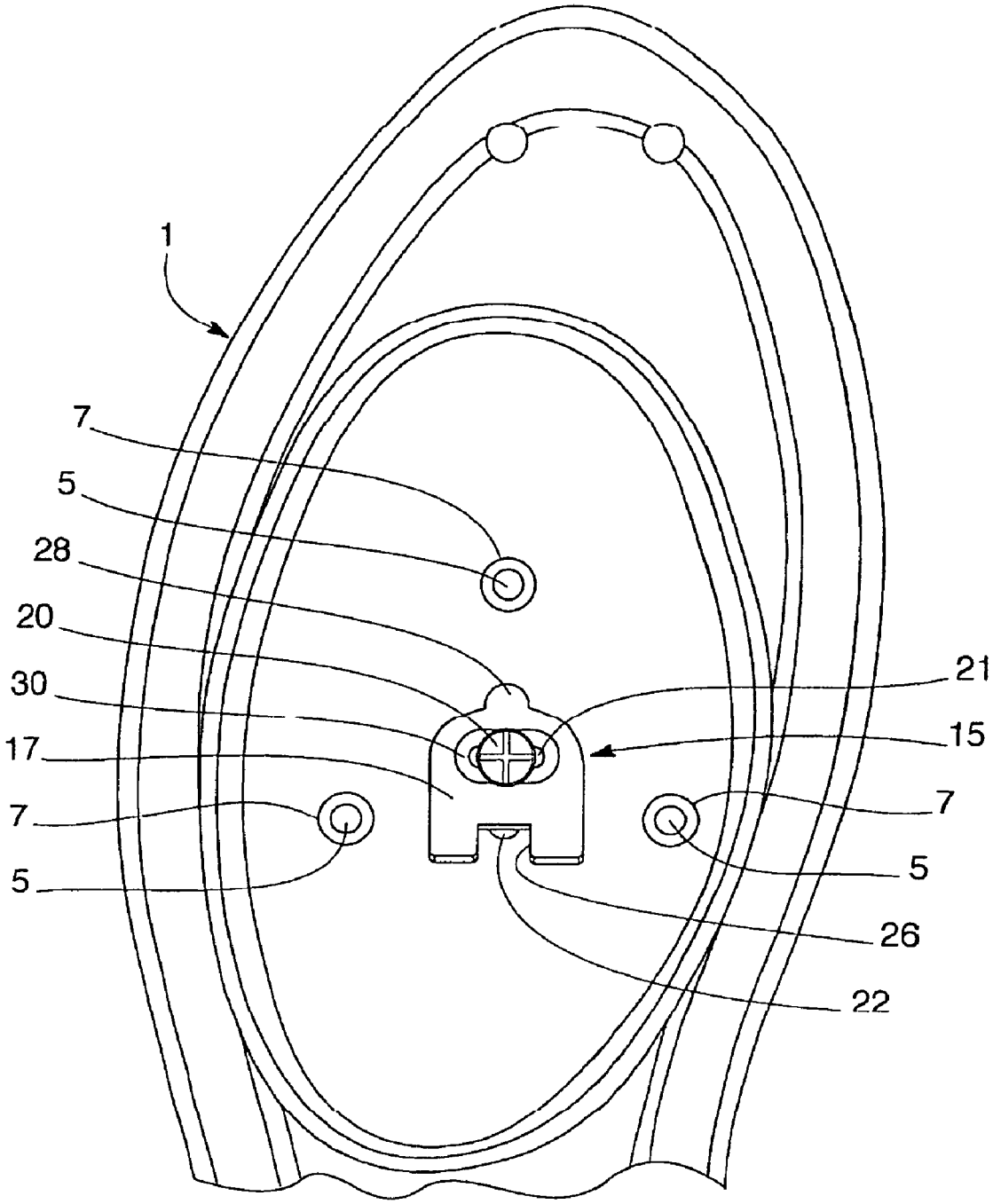

FIG. 10 corresponds to FIG. 9 after removal of the cleat with its securement screws, or else the second locating member remains in place to define the predetermined position of use of the removed cleat awaiting a new cleat.

In the drawings, identical or equivalent elements will bear the same reference numerals.

Figure 1:
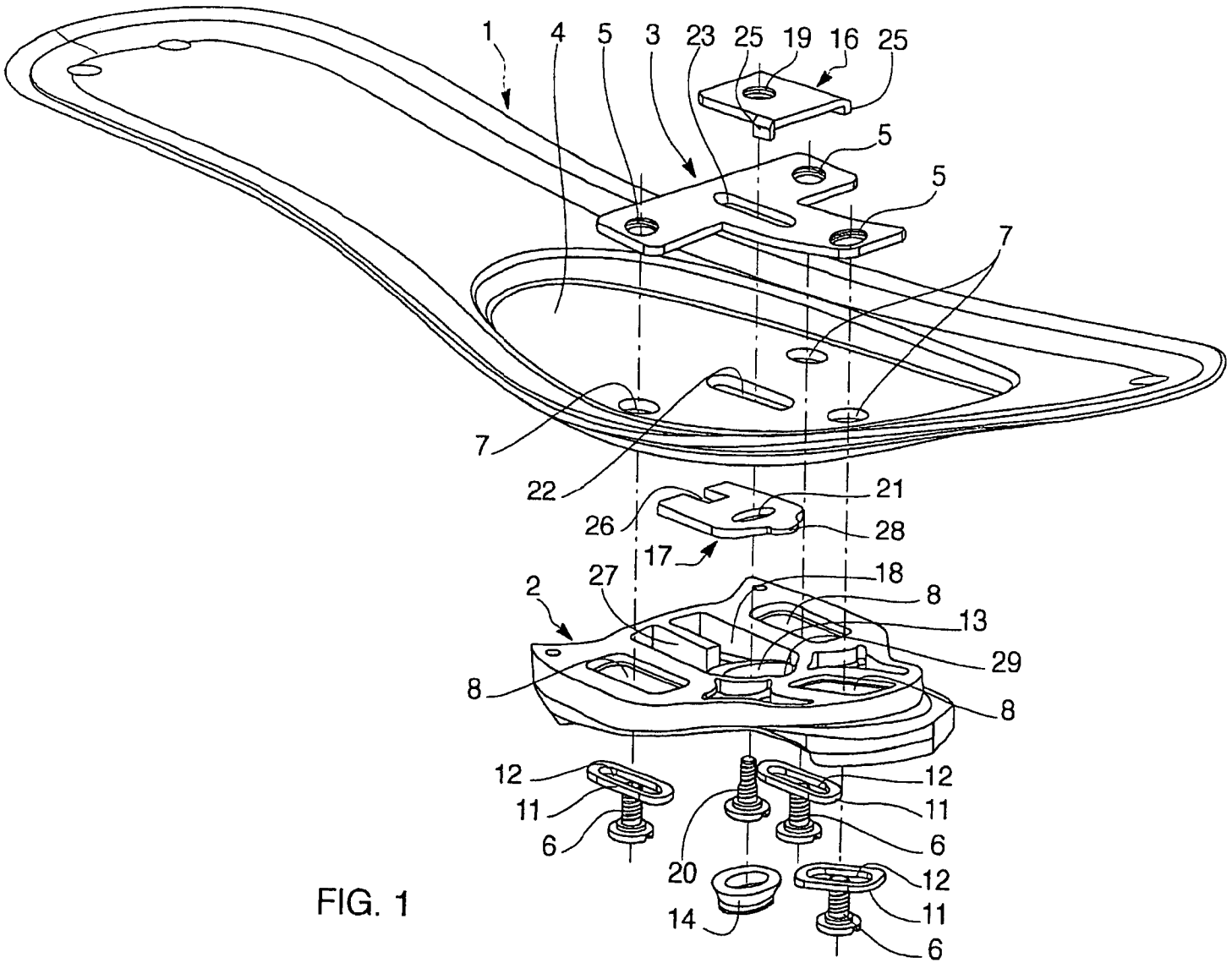
FIG. 1 is an exploded perspective view of a cyclist's shoe sole and of a retention cleat to be fixed below the sole, these elements comprising a locating device of the relative position of the sole-cleat according to a first embodiment of the invention.
Figure 2:
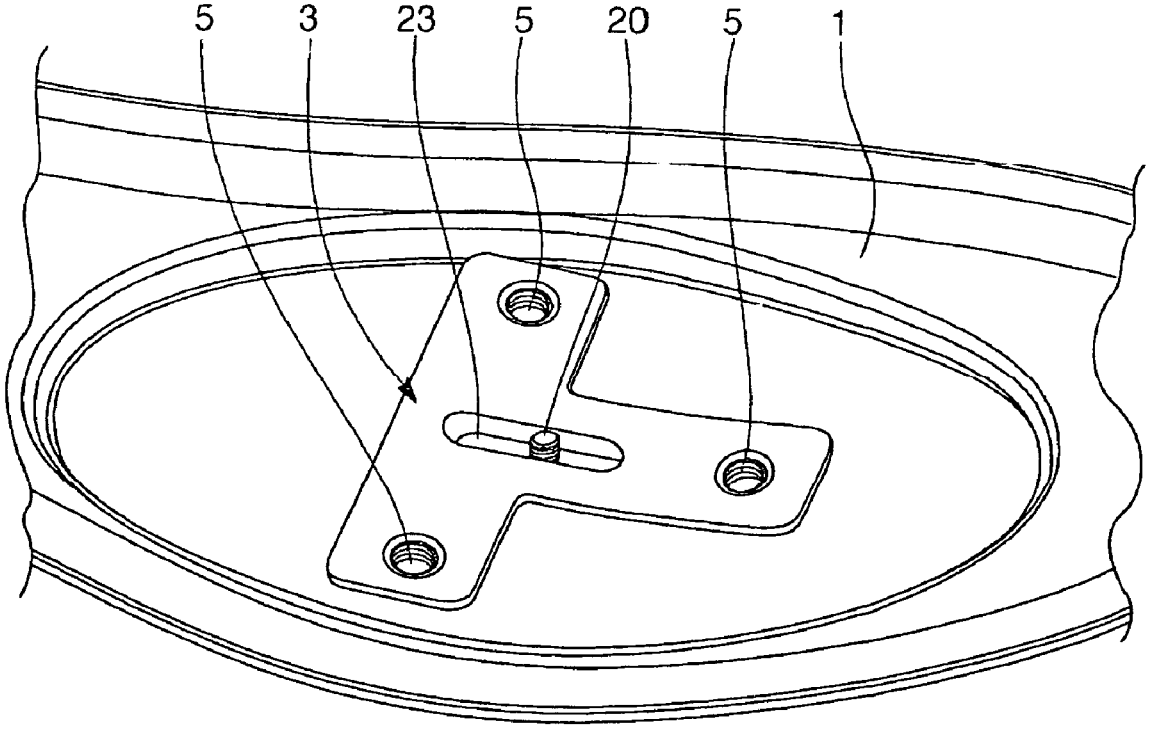
FIG. 2 is a fragmentary perspective view showing a T shaped element disposed in a recess of the sole and comprising three tapped holes for securement of a cleat, and a groove receiving a screw of the locating device.
Figure 3:
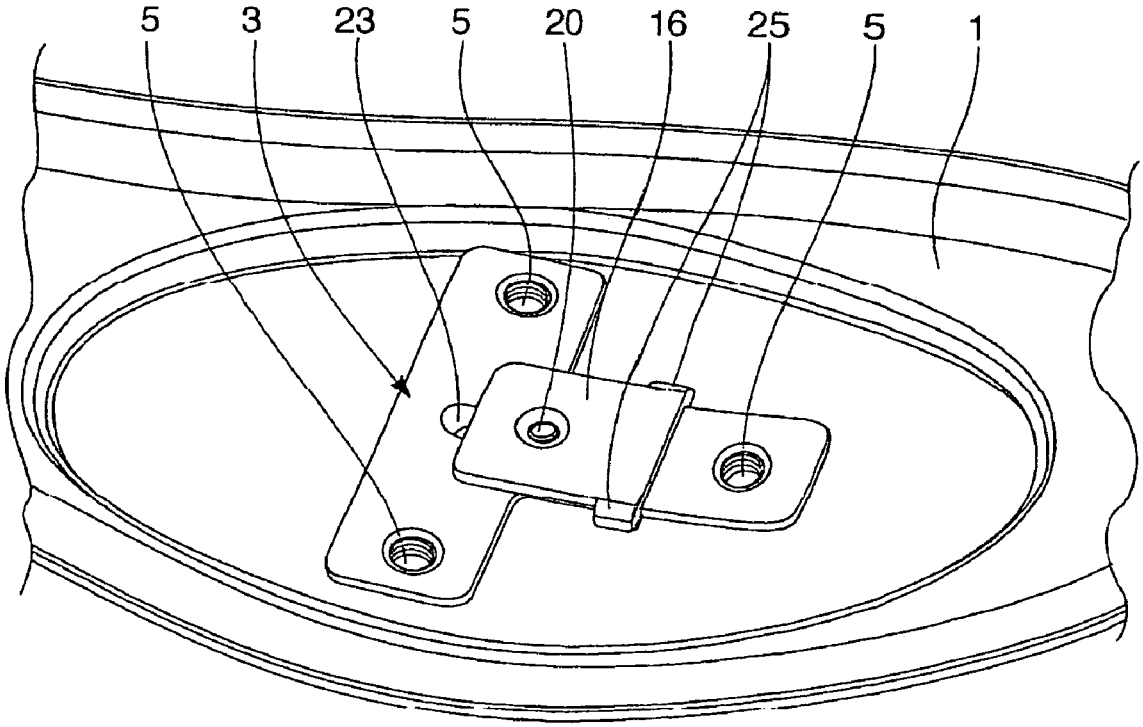
FIG. 3 is a perspective view corresponding to that of FIG. 2, completed by a first locating member forming a cursor on the stem of the T shaped element, the cursor being provided with a tapped hole for securement of the screw of the locating device.

The exploded view of FIG. 1 shows a sole 1 of a cyclist's shoe (not shown) and a cleat 2 for retaining the shoe on a cycle pedal (not shown). The cleat 2 has in the illustrated example an overall triangular shape.

The sole 1 is provided with securement means for the cleat disposed over the thickness of the sole. In the illustrated example, these securement means comprise a T shaped element 3 disposed in a recess 4 in the sole 1 and provided with a first securement member in the form of a tapped securement hole 5 at each end adapted to receive respectively a second securement member in the form of a securement screw 6 of the cleat 2 below the sole 1. The securement holes 5 are disposed facing through-holes 7 provided in the sole.

The securement screws 6 also extend through holes 8 provided through the retaining cleat 2, to be screwed into the securement holes 5 in the sole 1 so as to grip the cleat against the latter. The holes comprise a forward central hole and two rear lateral holes.

Figure 6:
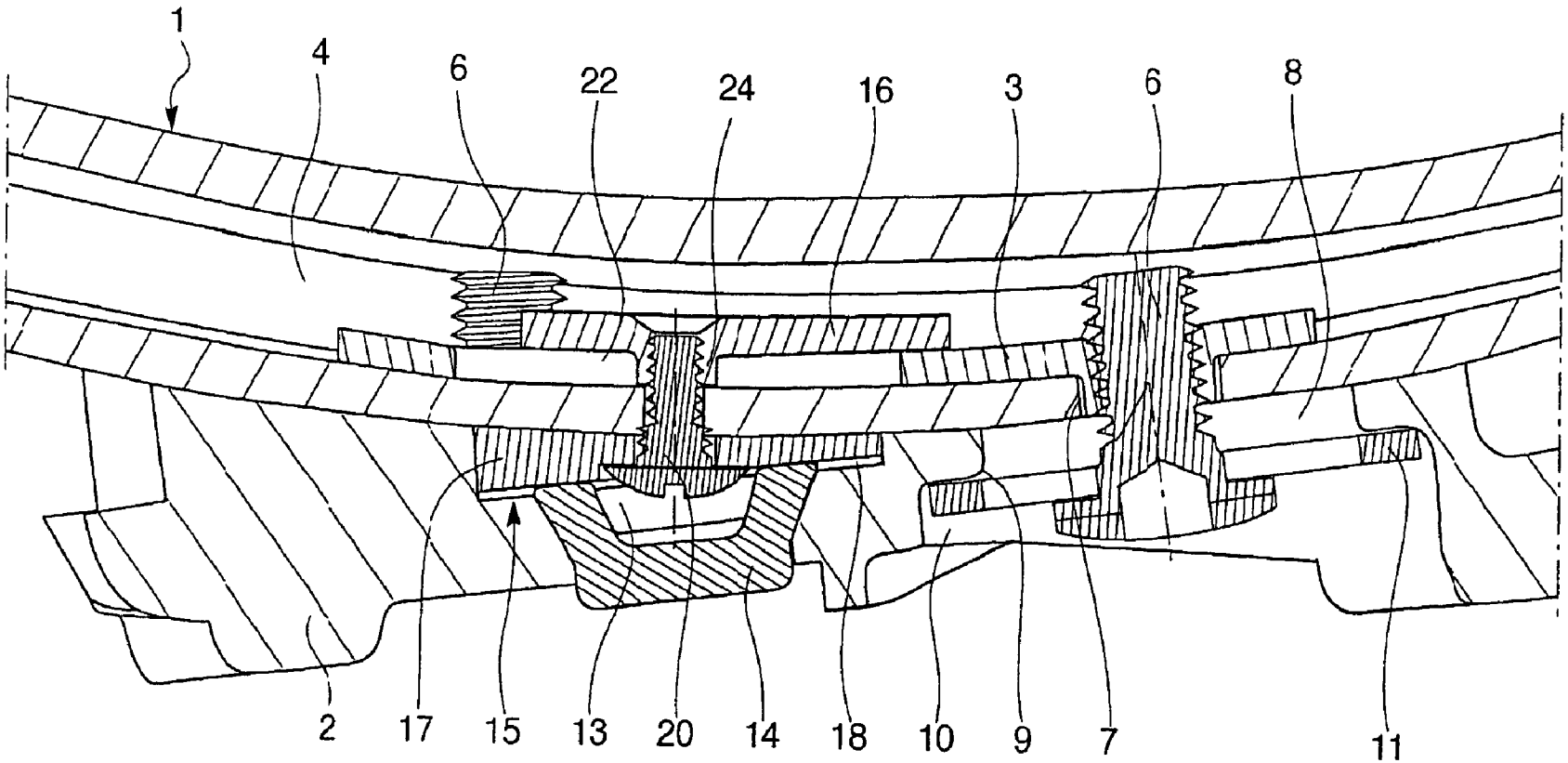
FIG. 6 is a fragmentary longitudinal cross-sectional view showing the cleat fixed below the sole of the shoe and the locating device defining the position of use of the cleat.

So as to permit the longitudinal positioning of the retaining cleat 2 relative to the sole 1, the through-holes 8 are in the form of longitudinal slots. The shoulder 9 (see FIGS. 6 and 7) is formed on the external surface of the cleat 2 about each longitudinal slot so as to define a seat 10 for an elongated crosspiece 11 provided with a longitudinal slot 12 aligned on the corresponding longitudinal slot 8 of the cleat 2 and having a reduced width relative to the width of the slot 8, the first width corresponding essentially to the shank of the screw 6.

Thus, each securement screw 6 extends through slots 8 and 12 such that its head bears against this crosspiece during gripping of the cleat against the sole 1.

Figures 7, 8:
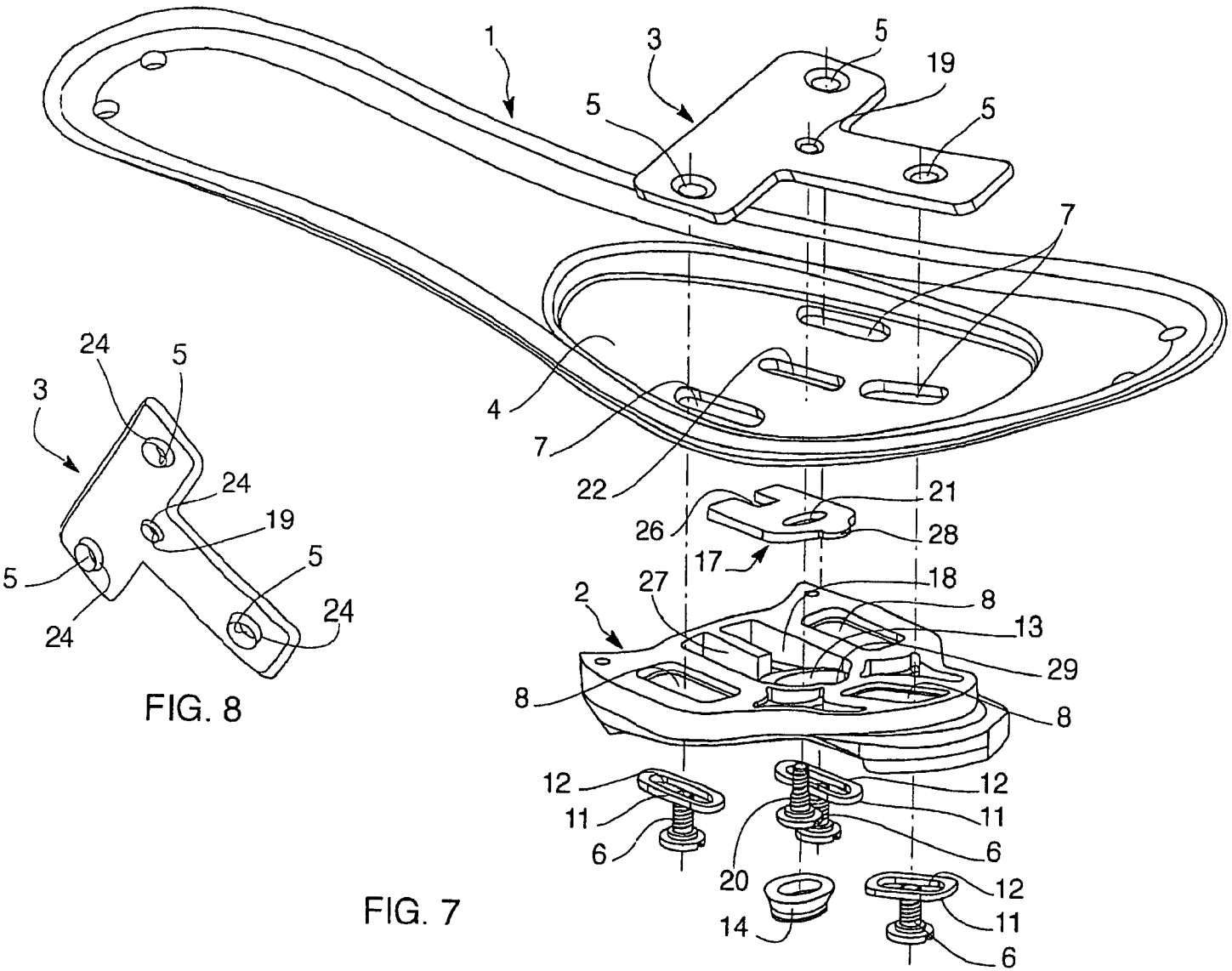
FIG. 7 is an exploded perspective view of a cyclist's shoe sole and a retention cleat to be secured below the shoe, these elements comprising a device for locating the relative sole-cleat position according to a second embodiment of the invention.
FIG. 8 is a perspective view from below of a T shaped element of FIG. 7.

So as also to permit a certain transverse positioning of the cleat 2 relative to the sole 1, the seat 10 has in known manner a width greater than that of the crosspiece 11 so as to permit a certain transverse movement of the crosspiece within the seat (see FIG. 7).

Before finally securing the cleat 2 below the sole 1, it is thus possible to carry out a longitudinal and transverse positioning of the cleat to place it in a predetermined position of use corresponding to an optimum position.

The retaining cleat 2 also comprises a central through-hole 13 constituting, in a manner known per se, a seat for a non-skid shoe 14 projecting on the external surface of the cleat.

According to the invention, the securement means of the cleat below the sole are associated with a locating device 15 of the predetermined position of use of the cleat 2, permitting the emplacement of a new similar cleat in this predetermined position of use. A first embodiment of this locating device 15 is shown in FIGS. 1 to 6 and 10.

The locating device 15 comprises locating means comprising the first locating member 16 mounted slidably in the longitudinal direction within the recess 4 of the sole 1, and a second locating member 17 disposed in a seat 18 provided on the upper surface of the retention cleat 2. These first and second locating members 16, 17 can be moved longitudinally and transversely relative to the sole 1 to be immobilized in the predetermined position of use of the cleat 2.

The first locating member 16 comprises a plate provided with a tap hole 19 adapted to coact with the screw threaded shank of a screw 20 constituting a connecting member between the first and second locating members 16, 17.

This connecting member is adapted to immobilize the first and second locating members 16, 17 relative to each other by passing through a transfer slot 21 provided in the second locating member, also in the form of a plate, and a longitudinal slot 22 provided in the sole 1 to be screwed into the tapped hole 19 of the first locating member 16.

In the example shown in the figures, in which the securement means of the cleat 2 comprise a T shaped plate 3 carrying a tapped securement hole 5 at each end, the plate 16 is mounted slidingly on the cursor on the main stem of the T shaped plate and as a result, this T shaped plate is provided with a longitudinal slot 23 disposed facing the longitudinal slot 22 of the sole 1 so as to permit the securement screw 20 to pass through and move longitudinally by being guided in slots 22, 23.

The first locating member 16, in the form of a plate, comprises preferably on its lower surface a protuberance 24 (see FIG. 6) which projects into the longitudinal slot 23 of the T shaped element so as to form a guide means for the plate 16 during longitudinal movement of this latter.

So as to hold the first locating member 16 in place on the T shaped element 3 when the securement screw 20 is absent, the first locating member 16 comprises moreover preferably a pair of lateral tongues 25. These tongues also ensure the blockage in rotation of the locating member 16 during gripping of the securement screw 20.

The plate of the second locating member 17 can enter freely into the seat 18 provided on the upper surface of the retaining cleat 2 when the latter is fixed below the sole 1. When this plate is located in the seat 18, it is entirely blocked by at least partial shape mating between the shape of the contour of the plate and the internal shape of the seat (see FIG. 4).

So as better to guide the plate at the second locating member 17 during its emplacement in the seat 18 of the cleat 2, the plate comprises at its rear end a central indentation 26 adapted to receive a projection in the form of a central rib 27 of complementary shape at the rear of the seat 18. Thus, the central rib 18 comes into longitudinal abutment against the bottom of the indentation 26 of the second locating member 17.

In the illustrated example, and also to facilitate guidance of the plate 17 during its emplacement in the seat 18, the latter comprises at its forward end a rounded protuberance 28 having a shape adapted to coact with the recess 29 of corresponding shape in the seat 18.

Moreover, the plate of the second locating member 17 comprises about the transfer slot 21 a shoulder 30 disposed on the external surface of the plate to serve as a bearing surface for the head of the securement screw 20 of the locating device 15.

Figure 4:
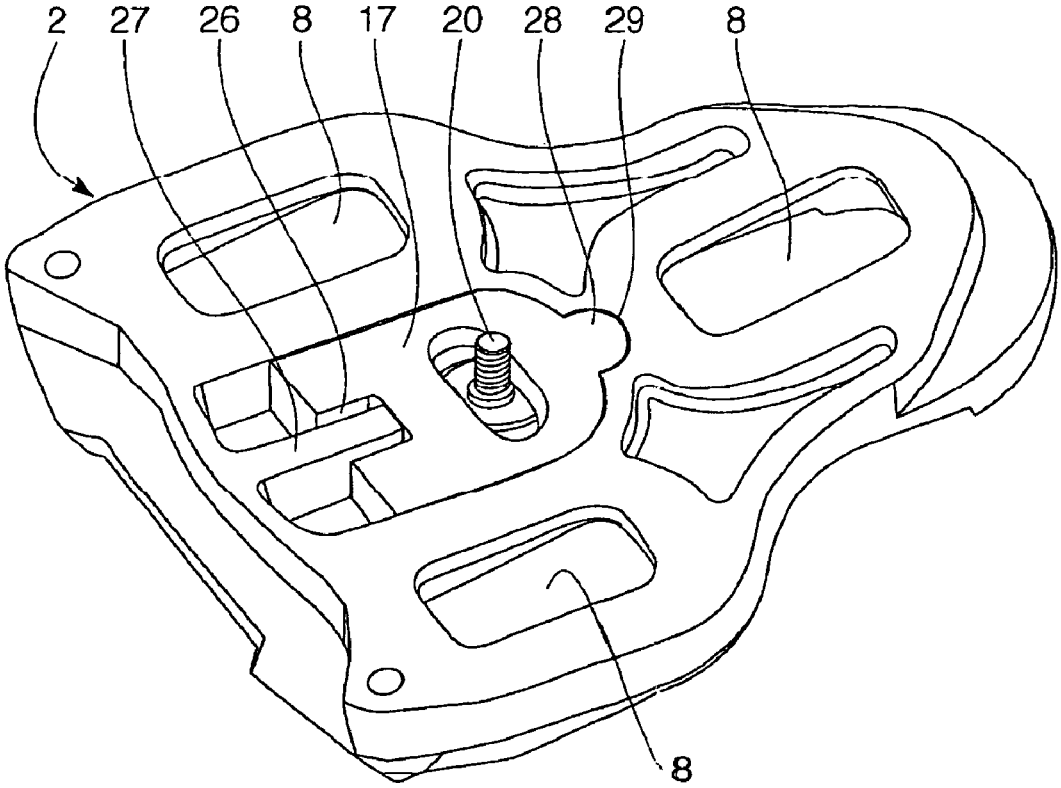
FIG. 4 is a perspective view showing a cleat provided with a seat for receiving a second locating member having the form of a plate, this plate being provided with a transverse groove.
Figure 5A:
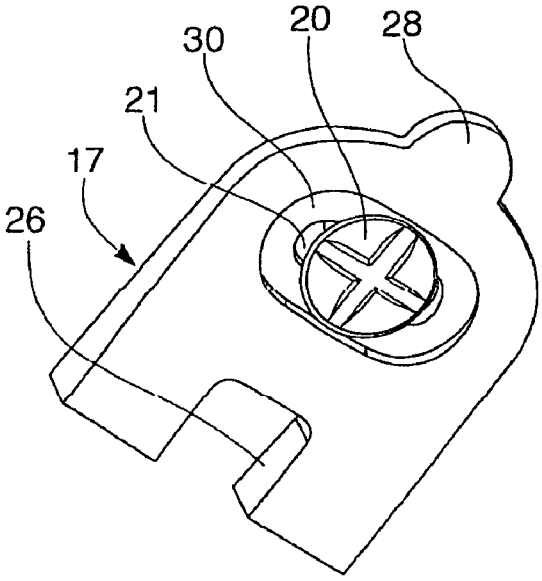
FIG. 5A is a perspective view of the second locating member of FIG. 4.
Figure 5B:
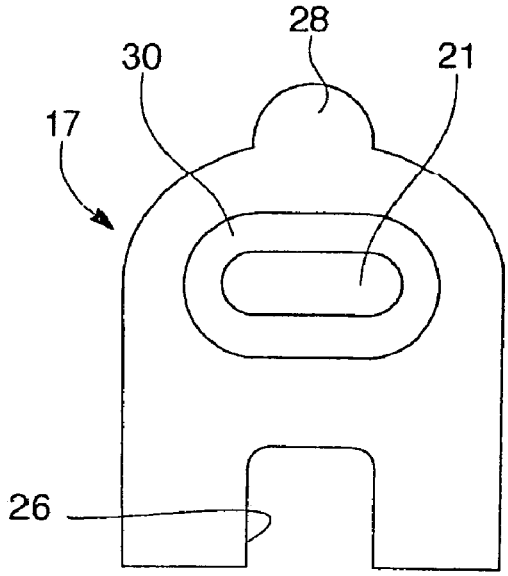
FIG. 5B is a bottom view of the second locating member of FIG. 4.

A second embodiment of the locating device according to the invention is shown in FIGS. 7 and 8, whilst FIGS. 4, 5 and 9 can be considered as common to the two embodiments.

FIG. 7 is an exploded view of this second embodiment which differs essentially from the first embodiment by the fact that the T shaped element serves as a first locating member and that as a result, the plate 16 of the first embodiment has been omitted.

The T shaped element is thus mounted longitudinally movable in the longitudinal direction of the sole 1 and it comprises at the place of the longitudinal slot 23 a tapped hole 19 adapted to receive the securement screw 20 of the second locating member 17 against the lower surface of the sole 1.

Moreover, the through holes 7 for securement of the cleat below the sole 1 are in this case constituted not by circular holes, but by longitudinal slots so as to permit the longitudinal movement of the T shaped element 3. The longitudinal slot 22 of the first embodiment remains the same.

For guiding the T shaped element 3, the latter comprises preferably on its lower surface about at least two of the securement holes 5 and 19, a protuberance 24 that projects into a corresponding slot. In the case in which only two of the securement holes 5, 19 are provided with such a protuberance 24, there are preferably selected the two holes 5, 19 which are aligned with each other on the stem of the T shaped element. However, these protuberances 24 can easily be provided without specific machining when the tapped holes are provided, and of course it is advantageous to provide about all four securement holes 5, 19 such a guide protuberance.

Thanks to the presence of the locating device 15 according to the invention, it is thus possible to carry out, during the first installation of a retaining cleat 2 below the shoe sole 1, a single initial positioning of the cleat in the longitudinal and transverse direction relative to the sole 1 to place the cleat in a predetermined position of use suitable for the user in an optimum manner, and to retain this same predetermined position of use during replacement of the cleat by a similar new cleat.

To this end, only the locating device 15 remains fixed below the sole after removal of the first cleat (see FIG. 10) so as to locate the exact position of this latter.

It is to be noted that during the first installation of the retaining cleat 2, one should first, after having placed the plate of the second locating member 17 in the seat 18 on the cleat 2, position and fix the cleat by three screws 6 before blocking the locating device by means of its securement screw 20. It can thus be noted that the locating device 15 will be automatically moved with the cleat 2 during the positioning of this latter.

Moreover, the securement screw 20 of the locating device 15 remains accessible through the central through hole 13 receiving the non-screwed shoe 14 such that it will be possible to carry out an adjustment of the position of use of the cleat at any time by first unlocking the securement screw 20 of the locating device 15, and then the three securement screws 6 of the cleat. Then the cleat can be moved with the locating device 15 in the longitudinal and transverse direction and when the adjustment is completed, all the screws 6 and 20 are again locked.

Thanks to the emplacement of the non-skid shoe 14 directly below the securement screw 20 of the locating device 15, the shoe also serves the function of a protective cover for this screw.

Of course, the invention is not limited the embodiment shown and described, those skilled in the art being able to supply modifications and variations without thereby departing from the scope of the invention.

The invention claimed is:

1. Cyclist's shoe comprising:

a sole (1) provided with securement means (5, 6) of a retaining cleat (2) of the shoe on an automatic cycle pedal, said securement means comprising first securement members (5) disposed in a thickness of the sole (1) facing through holes (7) provided in the sole and permitting said first securement members (5) to coact with second securement members (6) acting on said cleat (2) to grip the cleat against the sole;

positioning means (8 to 11) of the cleat (2) relative to the sole (1) permitting placing the cleat in a predetermined position of use before the securement of the cleat with the help of said securement means (5, 6); and a locating device (15) comprising locating means (3, 17; 16, 17) of said predetermined position of use of the cleat (2) permitting the emplacement of another similar cleat in said predetermined position of use.

2. Cyclist's shoe according to claim 1, wherein said locating means comprise a first locating member (3; 16) longitudinally movable relative to the sole (1), and connection means (20) passing through a longitudinal slot (22) in the sole (1) so as to connect said first locating member (3; 16) to a second locating member (17) so as to immobilize them relative to each other in said predetermined position of use of the cleat (2).

3. Cyclist's shoe according to claim 2, wherein the second locating member (17) is transversely movable relative to the sole (1).

4. Cyclist's shoe according to claim 2, wherein the first locating member (3; 16) is disposed in a recess (4) in the sole (1) and the second locating member (17) is received in a seat (18) provided on the upper surface of the cleat (2).

5. Cyclist's shoe according to claim 4, wherein said first locating member (3; 16) is mounted slidably in the longitudinal direction of the sole (1), and that said second locating member (17) comprises a transverse groove (21) receiving said connecting means (20) so as to permit the movement of said second locating member (17) in the transverse direction of the sole (1).

6. Cyclist's shoe according to claim 2, wherein said locating means (3, 17; 16, 17) comprise a T shaped element (3) extending in the longitudinal direction of the sole (1) and carrying at each end a securement hole (5) receiving one of said securement means (6) of the cleat (2).

7. Cyclist's shoe according to claim 6, wherein said first locating member comprises said T shaped element (3) mounted slidably in the longitudinal direction of the sole (1) and provided with a securement hole (19) adapted to receive said connecting means (20) of said first and second locating members (3, 17), and that said through holes (7) in the sole (1) are constituted by longitudinal slots disposed facing said securement holes (5) in said T shaped element (3).

8. Cyclist's shoe according to claim 7, wherein said T shaped element (3) comprises on its lower surface about at least two of the securement holes (5, 19) a respective protuberance (24) projecting into one of the corresponding slots (7, 22) of the sole (1) so as to form guide means for said T shaped element (3) during longitudinal movement of the latter.

9. Cyclist's shoe according to claim 6, wherein said first locating member comprises an element (16) mounted slidably on the stem of the T shaped element (3) and provided with a securement hole (19) adapted to receive said connecting means (20) of said first and second locating members (16, 17), and that said T shaped element (3) comprises a longitudinal slot (23) for reception of said connecting means (20) of said first and second locating members (16, 17).

10. Cyclist's shoe according to claim 9, wherein said first locating member (16) comprises on its lower surface about said securement hole (19) a protuberance (24) projecting into said longitudinal slot (23) of the T shaped element (3) so as to form a guide means for said first locating member (16) during longitudinal movement of the latter.

11. Cyclist's shoe according to claim 9, wherein said first locating member (16) comprises a pair of lateral tongues (25) extending on opposite sides of the stem of the T shaped element (3) so as to form lateral guide members.

12. Cyclist's shoe according to claim 2, wherein said second locating member (17) is in the form of a plate adapted to be blocked in said seat (18) on the upper surface of the cleat (2) by at least partial shape mating between the shape of the contour of said plate (17) and the internal shape of said seat (18).

13. Cyclist's shoe according to claim 12, wherein said plate (17) comprises at its rear end an indentation (26) receiving a projection (27) in said seat (18) on the upper surface of the cleat (2).

14. Cyclist's shoe according to claim 11, wherein said plate (17) comprises at its forward end a protuberance (28) having a shape adapted to coact with a recess (29) of corresponding shape of said seat (18).

15. A cyclist's shoe comprising:

a sole provided with securement means of a retaining cleat of the shoe on an automatic cycle pedal, said securement means comprising first securement members disposed in a thickness of the sole facing through holes provided in the sole and permitting said first securement members to coact with second securement members acting on said cleat to grip the cleat against the sole;

positioning means of the cleat relative to the sole permitting placing the cleat in a predetermined position of use before the securement of the cleat with the help of said securement means; and a locating device comprising locating means of said predetermined position of use of the cleat permitting the emplacement of another similar cleat in said predetermined position of use;

wherein said locating means comprise a first locating member longitudinally movable relative to the sole, and connection means passing through a longitudinal slot in the sole so as to connect said first locating member to a second locating member so as to immobilize them relative to each other in said predetermined position of use of the cleat, the first locating member being disposed in a recess in the sole and the second locating member being received in a seat provided on the upper surface of the cleat.

16. A cyclist's shoe, comprising:

means for securing a locating member to a sole of the shoe within a range of locating member positions; and means for separately securing a cleat to the sole of the shoe within a range of cleat positions;

wherein the position of the cleat relative to the sole of the shoe is defined by the secured position of the locating member on the sole.

17. The cyclist's shoe of claim 16, wherein the means for securing the cleat and the means for securing the locating member are constructed and arranged such that the secured cleat can be removed from the sole of the shoe without removing the locating member, thereby allowing removal of an original said cleat and replacement with a replacement said cleat, with the locating member defining the position of the replacement cleat with respect to the sole to be the same the position of the original cleat with respect to the sole.

18. The cyclist's show of claim 17, wherein the locating member defines the position of the cleat by fitting into a recess in the cleat that corresponds to a shape of the locating member.

19. The cyclist's shoe of claim 18, wherein the range of locating member positions allows for adjustment of the locating member both forward and back on the sole of the shoe, as well as side-to-side on the sole of the shoe.

20. The cyclist's shoe of claim 19, wherein the range of locating member positions allows for adjustment of a relative angle between the locating member and the sole of the shoe.

* * * * *